United States Patent [19]

Stillman

[11] Patent Number: 4,657,332

[45] Date of Patent: Apr. 14, 1987

[54] METHOD AND APPARATUS FOR CONVENIENTLY PROVIDING A 220 VOLT ELECTRIC OUTLET IN A HOME KITCHEN

[75] Inventor: Harold M. Stillman, Stamford, Conn.

[73] Assignee: Cuisinarts, Inc., Greenwich, Conn.

[21] Appl. No.: 752,135

[22] Filed: Jul. 5, 1985

[51] Int. Cl.[4] ..... H01R 13/713; H01R 33/72

[52] U.S. Cl. ..... 339/147 R; 339/192 RL; 219/451; 219/473

[58] Field of Search ..... 219/447, 451, 454, 473; 339/28, 147 R, 147 P, 166 R, 185 RL, 192 RL, 278 M

[56] References Cited

U.S. PATENT DOCUMENTS

| | | | |
|---|---|---|---|
| 2,448,215 | 8/1948 | George | 219/454 |
| 3,634,655 | 1/1972 | Jordan | 200/51 LM |
| 4,042,806 | 8/1977 | McCartney | 219/447 |
| 4,500,150 | 2/1985 | Leibensperger et al. | 339/28 |
| 4,506,141 | 3/1985 | Scott | 219/447 |

FOREIGN PATENT DOCUMENTS

| | | | |
|---|---|---|---|
| 2542107 | 3/1977 | Fed. Rep. of Germany | 200/51 LM |

*Primary Examiner*—Gil Weidenfeld
*Assistant Examiner*—Gary F. Paumen
*Attorney, Agent, or Firm*—Parmelee, Bollinger & Bramblett

[57] ABSTRACT

A 220 volt electric outlet is conveniently provided in a kitchen without requiring an electrician. The control switch for a heater element in an electric kitchen range is turned "OFF". This heater element is lifted from its well and unplugged or disconnected from the 220 volt terminals normally energizing it. An adapter with an attractive cover for this well carries a centrally located 220 volt outlet with electrical conductors extending downwardly and laterally to be connected to the supply terminals in the heater well. The adapter cover has a peripheral skirt which seats down flush against the top of the range. The 220 volt outlet is accessible to the user from the top of the electric range conveniently available for supplying power to appliances which desirably would utilize more power than is available from a 110 volt outlet, particularly heating and cooking appliances. For use the control switch is turned to "HIGH" for the heater well employed with this 220 volt outlet adapter. The adapter may incorporate a circuit breaker. The 220 volt outlet may be positioned in an offset location in the cover to be more conveniently accessible from one side of the adapter. The outlet may be supported in a raised column which in turn is mounted on the cover for facilitating access by the user. Such a column may include the 220 volt outlet facing horizontally from one side thereof or at an angle, such as 45° above horizontal.

16 Claims, 6 Drawing Figures

METHOD AND APPARATUS FOR CONVENIENTLY PROVIDING A 220 VOLT ELECTRIC OUTLET IN A HOME KITCHEN

BACKGROUND

In the vast majority of home in the United States there is no alternating current (AC) electrical outlet available for providing 220 Volt power, not even in the kitchen. The electrical outlets are usually nominally rated at 110 to 120 Volts AC at 15 Amperes of current. This rating meant that the maximum amount of electric power which is usually available from any such conventional outlet is approximately 1,650 Watts, assuming that there is no other electrical load being imposed on the circuit which is energizing the specific outlet.

The electrical power for energizing a resistance type of appliance, for example such as a heater, a wok, an oven, or an electric frying pan, is calculated as the product of the amperage times the voltage, which may be expressed as:

$$P=I\times E$$

where "P" is the power in Watts, "I" is the effective AC current, and 37 E" is the effective AC voltage. Thus, the maximum amount of power available at nominal 15 Amps. and nominal 110 Volts is about 1,650 Watts. If an attempt is made to draw more power than this maximum from any given circuit in the home, the limit of 15 Amps. will be exceeded, and the protective circuit breaker or fuse for that particular circuit will be tripped or melted in order to prevent over-heating of the wiring or connections in that circuit.

It would be desirable to have a higher level of electric power available in the home kitchen for certain types of very modern electrical appliances, such as woks, frying pans, and convection ovens, etc. However, at the present time such types of very modern higher power appliances are not practicable for the typical American home, because most consumers do not wish to undertake the significant expense and disruption of employing an electrician to install a 220 Volt power line extending from the electrical panel box to a special outlet in the kitchen.

It is to be noted that the kitchens in many, many homes in the U.S.A. are already equipped with electric ranges which are energized by a 220 Volt electrical circuit at approximately 50 Amperes and sometimes more. Thus, the electrical power for consumption in an electric range is approximately four to six, or more, times greater than the power which is available from a conventional 110 Volt electrical outlet.

As used herein the term "110 Volt" is used in an inclusive nominal sense to include all of the various levels of AC voltages which are actually available in conventional wall outlets in homes in various regions of the U.S.A., namely from about 105 Volts, or sometimes less, up to about 125 Volts, or sometimes more.

It is to be understood that the voltage actually available at any given time will depend upon many factors, including the over-all loads on the electric utilities. Moreover, AC voltages as nominally expressed are measured in accordance with a root mean square (R.M.S.) measurement.

Similarly, as used herein the term "220 Volt" is used in an inclusive nominal sense to include all of the various levels of AC voltages which are actually available for energizing kitchen ranges in homes in various regions of the U.S.A., namely from about 210 Volts, or sometimes less, up to about 250 Volts, or sometimes more.

As used herein the term "electric range" is used generically to include all of the types of electric kitchen cooking equipment which have removable electrical heater elements in top surfaces which are usually at approximately the level of counter tops, such equipment sometimes being called "electric stoves" or "cook tops", and even including electric ovens which often have removable electrical heater elements in top surfaces sometimes located above an oven chamber and sometimes located below and in front of an oven chamber.

SUMMARY

Accordingly, it is an object of this invention to provide a 220 Volt AC outlet for an electrical appliance in a home kitchen without going to the expense and disruption of providing such outlet by installing a separate 220 Volt line from the panel box into the kitchen to such an outlet.

A further object of the present invention is to provide a 220 Volt electric outlet in a home kitchen by employing one of the wells in an already existing electric range in the kitchen by removing a removable heating element which normally rests down within such a well and by disconnecting or unplugging the heating element from its electrical supply terminals located down inside of the well and by providing an adapter in the form of an attractive cover for this heater well carrying a 220 Volt outlet with electrical conductors extending downwardly from this outlet adapted to be connected to or plugged into the supply terminals which were previously used to energize the removed heater element, the adapter being adapted to seat down into the well neatly covering the well, with the 220 Volt outlet in the adapter accessible to the user from the top of the range.

Advantageously, this invention provides a 220 Volt electric outlet in a home kitchen by utilizing one of the wells of an electric range by inserting an adapter in place of the removable heating element previously located in the well, the adapter containing a 220 Volt outlet accessible from above and being easy to install and mount in the well, having connections available for being connected to the supply terminals in the well previously used for energizing the removed heater element and having a cover which seats down attractively for covering over the well and for supporting the outlet.

In carrying out this invention in an illustrative embodiment thereof, a method of providing a 220 Volt AC outlet from the well of an electric range comprises removing one of the heating elements from its well in the top of an electric range and providing a cover for the well of the removed heater element, such cover carrying a 220 Volt electrical outlet accessible from above the cover and having electrical conductors extending down from the outlet accessible to be connected to or to be plugged into the electrical supply terminals in the well of the removed heater element for coupling the 220 Volt outlet in the cover to a source of 220 Volt AC electrical energy and covering the well with the cover containing the outlet, thereby making this outlet accessible to the user from the top of the electric range with the well of the electric range supplying mounting support for enabling electrical appliances to be plugged into the outlet contained in the cover.

In accordance with the present invention in the illustrative embodiment thereof a 220 Volt electrical outlet is mounted in a cover plate so that this outlet is accessible from above the cover plate, and this cover plate and outlet form an adapter which is to be adapted to be placed over a well in the top of an electric range from which the heater element has been removed and disconnected from its upply terminals within the well. This adapter outlet has electrical conductors extending downwardly below the cover plate in position ready to be connected to the supply terminals which previously were used to energize the removed heater element. After these conductors have been connected to the heater supply terminals, the cover plate is placed over the well and utilizes the range top to support the cover plate and its 220 Volt outlet in readiness to have an electrical appliance plugged into the outlet. If desired, the adapter may include a circuit breaker set at a predetermined current rating less than that for the range as a whole.

BRIEF DESCRIPTION OF THE DRAWINGS

The invention, together with further objects, features and advantages thereof will be more fully understood from a consideration of the following description taken in conjunction with the accompanying drawings in which like elements are designated with the same reference numerals throughout the various views. Also, the various elements are not necessarily illustrated to scale in order to enhance understanding and more clearly show and describe the invention.

Figure 1:
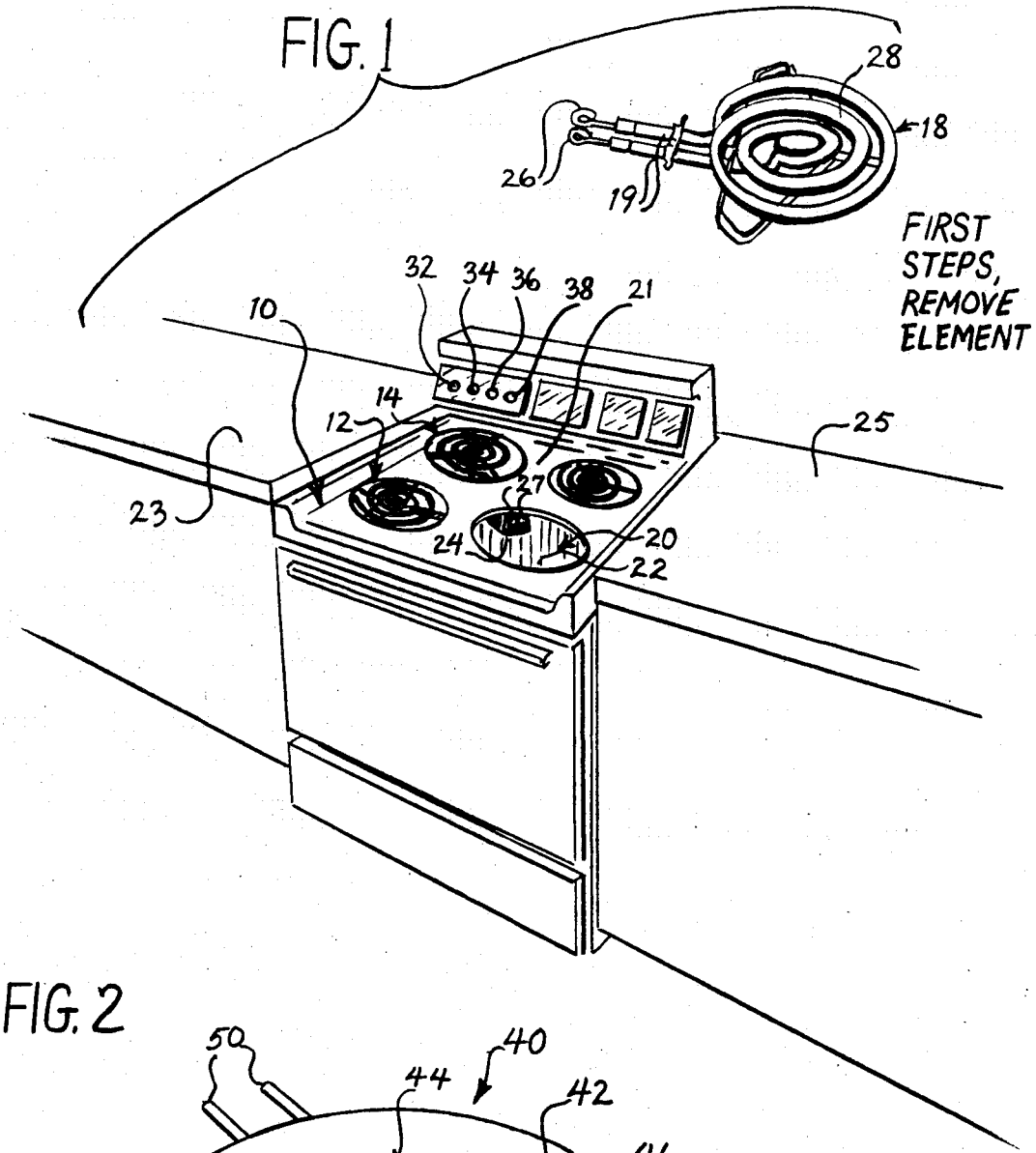
FIG. 1 is a perspective view of an electric range in a home kitchen with counters on either side of the range and illustrating the removal of a heating element from one of the wells in the top of the range.

With reference now to FIG. 1, a 220 Volt electric stove or range 10 is illustrated in a home kitchen and has a plurality of removable electric heater elements 12, 14, 16 and 18 mounted in heater wells 20 in the top surface 21 of the electric range 10. Each well is usually characterized by having a circular rim 22 and has electrical connector supply terminals in an outlet 24 located down in the well positioned to one side beneath the top surface 21 of the range for energizing the heater element mounted in that well. This top surface 21 is usually at about the same height as kitcheh counter tops 23 and 25.

One of the front heater elements as indicated at 18 is shown removed from its well 20. This heater element 18, similar to the other heater elements 12, 14 and 16, includes electrical connection means 19 having terminals or prongs 26 which are normally connected, for example, by removably plugging into a pair of supply terminals or connectors 27 in the heater supply outlet 24, which normally furnishes 220 Volt electrical energy for the heater element 18. Such heater elements 18 are generally circular as seen in plan view and may include a spider-like support bracket 28 which removably seats down into the well 20 above a removable grease-catching pan or tray (not shown) which is normally positioned down in the well below the heater element. Such a grease-catching pan has a clearance opening for enabling the connection means 19, 26 to have access to the supply outlet 24, 27.

The terminals 26 of such a heater element 18 are dismountable, for example by unplugging from the heater well socket 24, in order to enable replacement of such heater element in the event of its malfunctioning. The spider 28 acts as a support bracket for the heater element 18 when it is plugged into its supply socket 24 so that the heater element can support and carry cooking implements such as pots, pans, kettles, etc., which are positioned on the heating elements during use.

The range 10 includes manually operable control switches 32, 34, 36, 38 which are used to turn "OFF" and "ON" the respective heater elements 12, 14, 16 and 18 and to adjust their respective heat level settings, for example such settings as: "Simmer", "Low", "Medium Low", "Medium High" and "High". It is to be understood that the control switch 38 for the particular heater element 18 to be removed is turned "OFF" before removal of this heater element is begun. All of the other control switches 32, 34, and 36 are also turned OFF so that the other nearby heater elements are safely deenergized during removal of the particular heater element 18. Also, the safest proceedure is to turn "OFF" the circuit breaker in the electric panel box for the entire range 10.

It is to be understood that in accordance with the present invention any one of the heater elements 12, 14, 16 or 18 may be removed. For convenience of illustration it is the right front heater element 18 which happens to be shown being removed.

Figure 2:
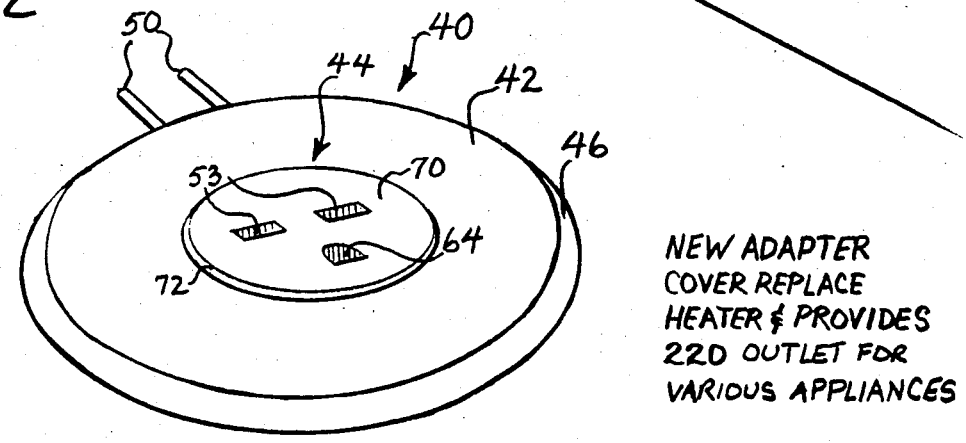
FIG. 2 is a perspective view as seen from above of an adapter including a cover plate carrying a 220 Volt electrical outlet mounted in the center of the cover plate and with a pair of terminals seen projecting out from one side below the level of the cover plate. This adapter is conveniently mountable in the well in the range from which the heater element has been removed.

An adapter 40 (FIG. 2) is provided having a circular cover 42 carrying centrally therein a 220 Volt electric outlet 44. This cover 42 has a downwardly sloping peripheral skirt 46 which is adapted to rest on the rim 22 of the well 20 when the adapter 40 is seated down in the well. The perimeter of the skirt 46 is slightly larger than the diameter of the well rim 22 in the top surface 21 of the range 10 so that this skirt 46 will conveniently rest down upon the rim 22 for strongly supporting the cover plate 42 with its outlet 44.

In order to align the cover plate 42 with the well 20 and to removably lock or hold the cover in place to prevent shifting or inadvertent lifting of the adapter 40 once it has been installed, there are locator detent means 48 (FIG. 3) projecting down from below the cover 42 and positioned below this cover for engaging within the well rim 22, for example such as a plurality of downwardly projecting locator spring clip tabs 48 uniformly spaced inwardly from the perimeter of the skirt 46. These spring clip tabs 48 snap into the rim opening 22 for preventing inadvertent dislodgement of the installed adapter 40 when unplugging from the outler 44. A finger notch 49 of generally semicircular shape is provided in the peripheral skirt 46 so that the user can insert a finger beneath the margin of the cover 42 for pulling up on the cover to overcome the holding grip of the detent clip tabs 48 when desired to remove the installed adapter 40.

Figure 3:
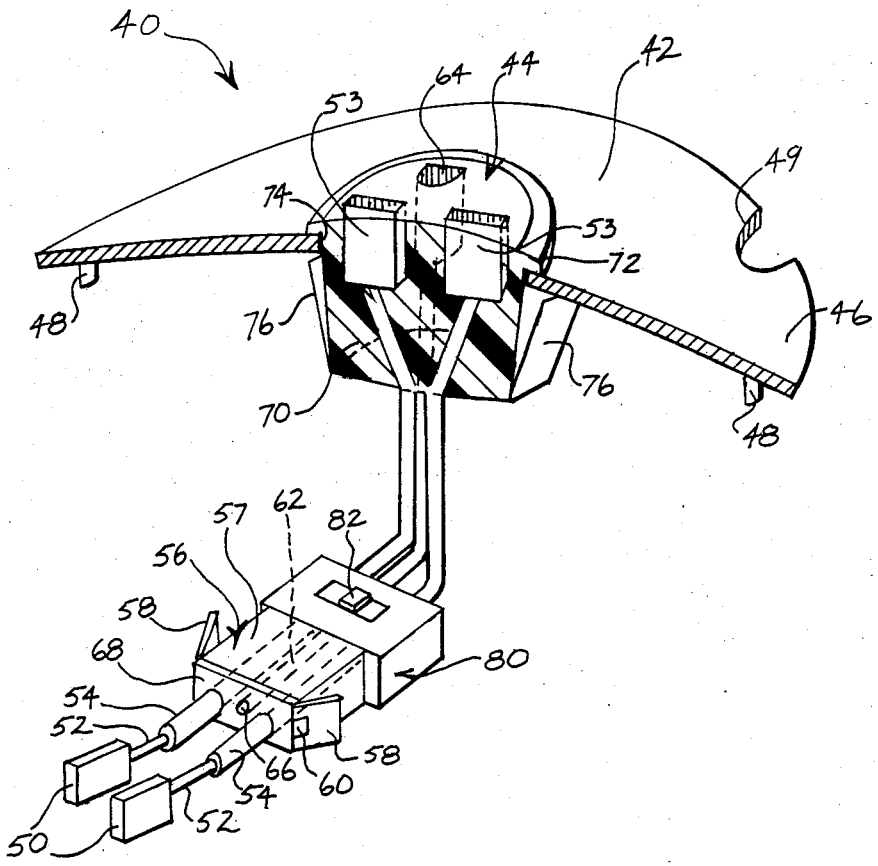
FIG. 3 is a cut-away perspective view somewhat enlarged from FIG. 2 showing the arrangement of the 220 Volt outlet in the cover plate with its electrical connections extending downwardly and laterally from the centrally located outlet and including a plug and circuit breaker.

As shown more fully in FIG. 3, the adapter 40 includes a pair of terminals 50, for example such as prongs or tabs extending from the ends of a pair of electrical conductors 52 having respective insulating sheaths 54, such insulated conductors extending through a plug 56. These terminals 50 are adapted to be inserted into or connected with the electrical supply connectors 27 in the socket 24 located down inside the well 20 for energizing the female "live" connectors 53 in the outlet 44 with 220 Volt AC electrical power. The body 57 of the adapter plug 56 is formed of rigid electrically insulating material, for example of durable plastic or ceramic material and is shown equipped on opposite sides with a pair of outwardly flaring spring retainer clips 58 each having a latch opening 60 therein. These retainer clips 58 are adapted to releasably engage with mating retainer means associated with the electrical supply outlet means 24 in the well 20, and these retainer clips are released by resiliently deflecting them inwardly toward each other. It is to be understood that these releasable leaf-spring retainer clips 58 are shown as illustrative of a wide variety of releasable retainer means which may be provided for releasably retaining the terminals 50 in engagement with the supply terminals 27 in the heater well electrical supply socket 24, depending upon the particular arrangement of the socket 24 and its associated plug retainer means.

In addition to the two conductors 52 there is a "grounding" conductor 62 located between them and extending to a "ground" female connector 64 located in the 220 Volt outlet 44. This grounding conductor 62 is mounted in the body 57 of the plug 56 and includes a grounding terminal 66 located in the front face of the plug 56 adapted to engage with the ground circuit of the range 10 so that the socket connector 64 in the outlet 44 is at "ground" potential. The whole chassis of the range 10 is electrically grounded, and thus the ground circuit of the range, which is electrically engaged by the grounding terminal 66, may be an exposed metal portion of the range chassis near the supply socket 24.

In this illustrative embodiment the grounding terminal 66 is electrically connected to a conductive metal grounding strap 68 which extends across the front of the plug 56. This strap 68 is connected to the two retainer clips 58, and thus the engagement of these retainer clips 58 with the mating retainer means in the well 30 serves for grounding the connector 64 in the outlet 44. The two conductors 52 are electrically insulated from the grounding strap 68.

The body 70 of the outlet 44 is formed of rigid electrically insulating material, for example of durable plastic or ceramic material, and it includes a peripheral flange 72 which seats down upon the margin of a mounting hole 74 located in the center of the cover plate 42.

In order to secure the outlet 44 in its mounting hole 74, retaining means 76 are provided. These retaining means 76 are shown as a pair of resilient detent spring fingers which are squeezed toward each other for enabling the body 70 of the outlet 44 to be inserted down through the opening 74. Then, when the flange 72 is seated down onto the cover 44, these spring fingers 76 are released to spread apart somewhat for releasably securing together the cover 42 and the outlet 44.

The conductors 52, 52 and 62 for the outlet 44 extend downwardly and laterally so that the terminals 50 are positioned to be conveniently connected to the electric supply means 24, 27 in the burner well. The grease pan or tray (not shown) which is usually located down in the well below the heater element 18 is removed to provide more room before installing the adapter 40. A circuit breaker 80 is shown included in the adapter 40. For example, the circuit breaker may be located near the plug 56. It is usually set to a lower current rating than the circuit breaker for the range 10 as a whole. For example, if the range circuit breaker in the panel box is set for 50 Amperes, then the circuit breaker 80 may be set for 30 Amperes, and it has a reset button 82.

After the adapter 40 has been installed the control switch 38 for the supply means 24, 27 in the burner well 20 is turned to "HIGH", whenever the user wishes to plug a 220 Volt rated electrical appliance into the outlet 44.

It is to be understood that there may be heater well supply outlets 24 which have more than two supply terminals 27 for energizing heater elements 18 which also have more than two terminals 26, in which event the terminals 50 in the plug 56 are arranged and oriented so as to be connected with two supply terminals in the outlet 24 which become "live" (energized) with 220 Volt AC power when the control switch 38 is put in the "HIGH" setting.

In order to provide convenient access to the outlet 44, it may be positioned in an offset location in the cover 42 so as to be more accessible from one side of the adapter 40. The outlet 44 may be supported in a raised column 84 which in turn is mounted in the adapter cover 42 for facilitating access by the user.

Figure 4:
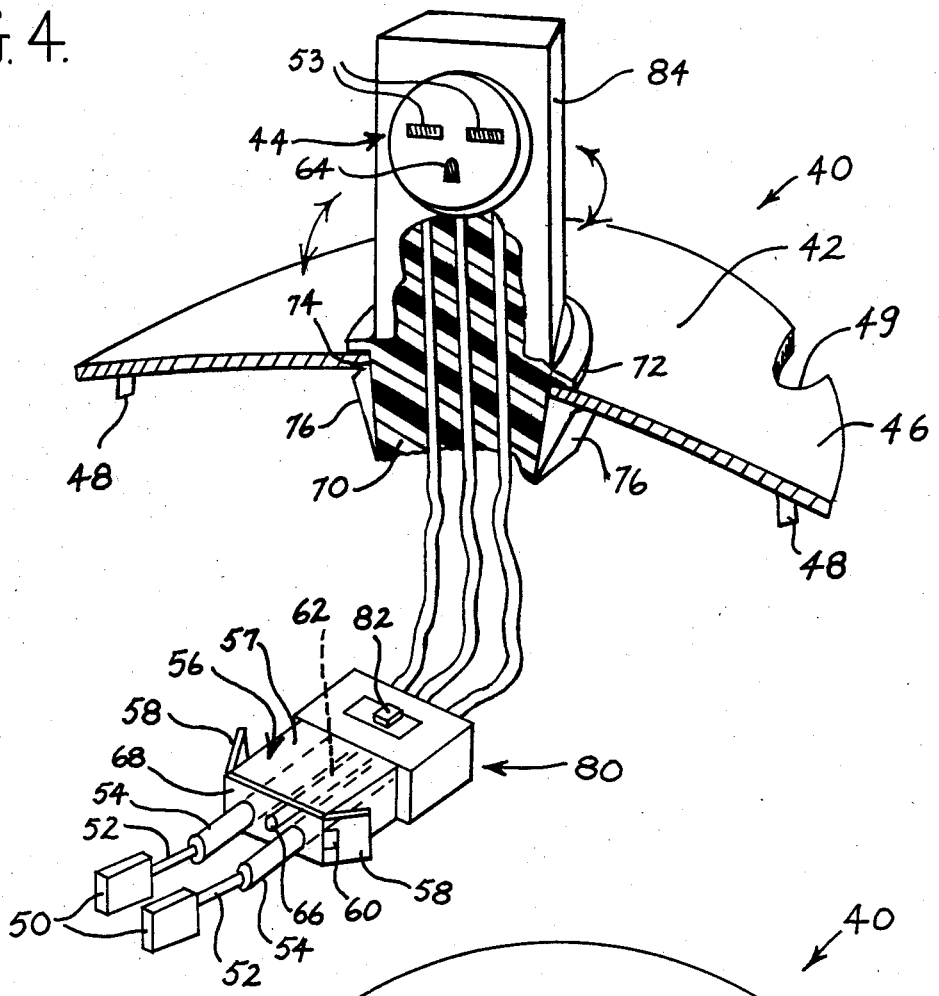
FIG. 4 is a perspective view similar to FIG. 3 showing a 220 Volt outlet in a raised column rotatably mounted in the adapter cover.
Figure 5:
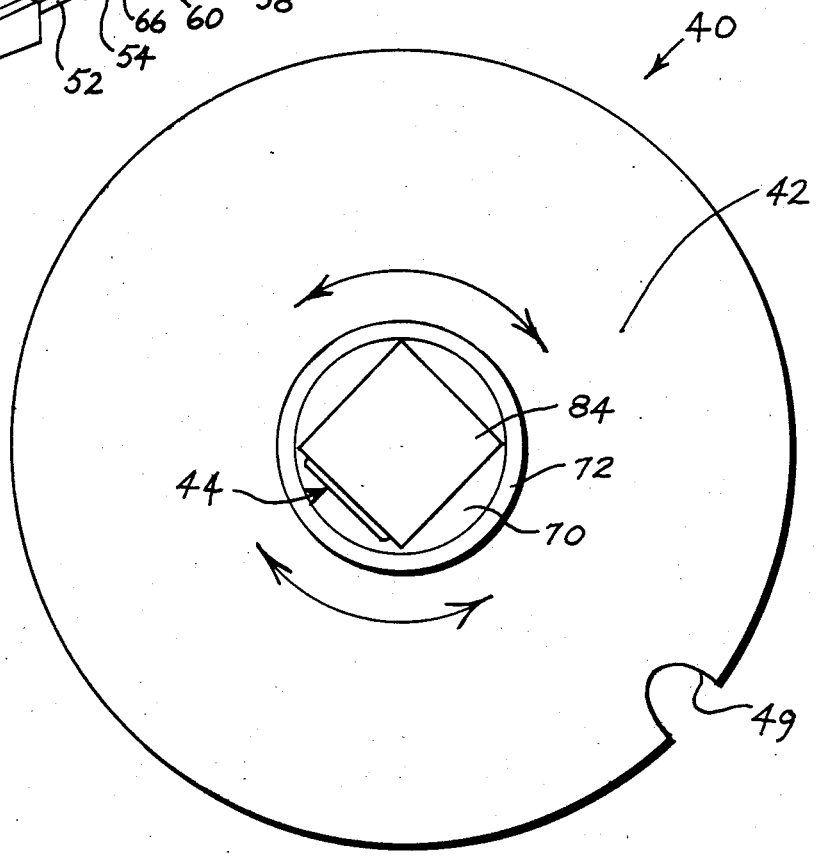
FIG. 5 is a top plan view of the adapter unit of FIG. 4.
Figure 6:
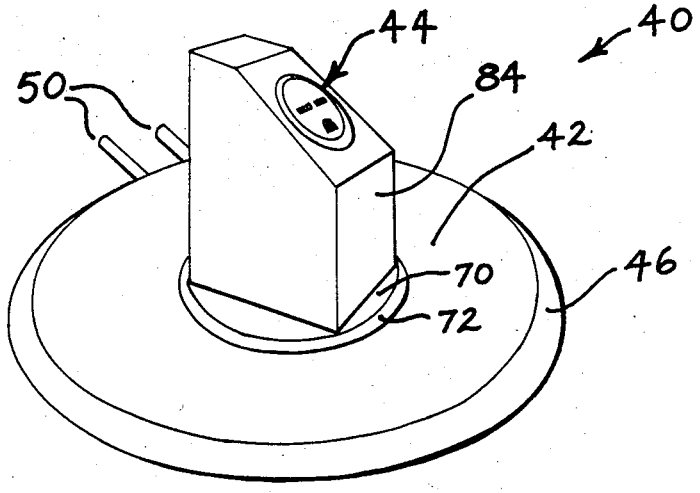
FIG. 6 is a perspective view of a 200 Volt outlet in a raised column and facing at an angle of 45° above horizontal.

For example, such a column may include the 220 Volt outlet 44 facing horizontally laterally from one side thereof (FIG. 4) so that the user may have access from a horizontal direction for avoiding bending the appliance electrical cord from vertical over to horizontal. Also, for example, the outlet 44 may be inclined so as to face laterally and upwardly from the column at an angle intermediate horizontal and vertical, for example such as at an angle of 45° above the horizontal (FIG. 6) for convenience of the user. When the outlet is mounted in such a column and faces laterally, for example horizontally or at an inclination, then the column itself may be rotatably mounted in the cover 42 for accommodating 180° of rotation of the column about a vertical axis relative to the cover so that the outlet may be turned to face to the right or to the left or toward the front of the range for convenience of the user, depending upon the most convenient direction to run the cord and plug from the appliance. Also, the outlet 44 itself may be carried at the end of a flexible cord which extends from the cover 42 beyond the edge of the range 10 for ready accessibility to the user.

Among the features of this adapter 40 are the following:

1. It is "plug compatible" with the 220 Volt supply means 24, 27 located in the well 20 which previously energized the removed heater element 18.

2. It provides a 220 Volt outlet 44 which has a "grounding" connector 64 in addition to the two "live" connectors 53.

3. It can be installed and removed conveniently and easily from a heater well 20.

4. It can be installed in any one of the heater wells of an electric range 10.

5. If the well openings in the top surface 21 in the range 10 are greatly different in size, then a different size of cover plate 42 can be mounted onto the outlet 44 by squeezing the spring fingers 76 to remove and replace the cover plate 42. The hole 74 is sufficiently large to pass over the circuit breaker 80 and the plug 56 with its retainer means 58.

6. The cover 42 neatly and fully covers the well opening 22 in the top surfaces 21 of the range, thus making a neat and strong installation.

7. The plug 56 is releasably retained in place by the retainer means 58 preventing inadvertent pull-out disconnection of this plug.

8. The adapter 40 may includes its own circuit breaker 80.

Thus, a 220 Volt outlet 44 is conveniently provided in the home kitchen which may be utilized to operate very modern 220 volt appliances which would otherwise be impractical because of the lack of an available 220 Volt outlet.

Since other changes and modifications varied to fit particular operating requirements and environments will become recognized by those skilled in the art, the invention is not considered limited to the examples chosen for purposes of illustration, and includes all changes and modifications which do not constitute a depearture from the true spirit and scope of this invention as claimed in the following claims and equivalents to the claimed elements.

What is claimed is:

1. A method of conveniently providing a 220 Volt AC electric outlet in a home kitchen comprising the steps of:

turning "OFF" electric power at least for a predetermined heater element in the top surface of an electric range in the kitchen which is supplied by 220 Volt AC electric power, removing the predetermined heater element from its well in the top surface of the range, electrically disconnecting the removed heater element from all of the electrical connections located in the well which previously supplied the heater element with electric power, providing a cover for the well of the removed heater element including a 220 Volt AC electric outlet accessible from above the cover and having two "live " connectors and a "grounding" connector, electrically connecting the two "live" connectors of this outlet with those supply connections located in the well which previously energized the removed heater element with 220 Volt AC electric power when the control switch for the removed heater element was put into its "HIGH" setting, electrically connecting the "grounding" connector in the outlet to a "ground" circuit located in the well of the electric range, placing the cover over the well, and turning "ON" the electric power to those supply connections in the well, including putting the control switch therefor into its "HIGH" setting when it is desired to use the 220 Volt AC outlet in the cover placed over the well.

2. The method of conveniently providing a 220 Volt AC electric outlet in a home kitchen, as claimed in claim 1, including the step of:

providing a circuit breaker operatively associated with the electric outlet for interrupting the flow of electric power to the "live" connectors in the outlet in the event that the electric current drawn from the outlet exceeds a predetermined limit set by the circuit breaker.

3. An adapter for converting the electrical connections for a removed heater element in a well in the top surface of an electric range in a home hitchen evergized by a source of 220 Volt AC electric power to a 220 Volt AC electric power outlet in the home kitchem, comprising:

a cover fitting over the well in the top surface of the electric range in the kitchen from which the heating element normally seating in the well was removed and disconnected from all of its electrical connections in the well including those capable of supplying 220 Volt AC electric power, said cover having a 220 Volt AC electric outlet mounted therein, and said outlet having electrical connections extending down from the outlet below said cover adapted to be connected to the supply connections in the well for the removed heater element for supplying 220 Volt electric power to said outlet.

4. An adapter as claimed in claim 3, in which:

said electrical connections for the outlet include a plug having a pair of projecting terminals and a "grounding" connection, said projecting terminals being adapted to be plugged into a pair of connectors in an outlet in the well capable of supplying 220 Volt AC electric power.

5. An adapter as claimed in claim 3, in which:

said electrical connections for the outlet include a circuit breaker.

6. An adapter as claimed in claim 4, in which:

said electric connections for the outlet include a circuit breaker.

7. An adapter as claimed in claim 4, in which:

said plug includes a circuit breaker therein.

8. An adapter for converting the electrical connections for a removed heater element in a well in the top surface of an electric range energized by a source of 220 Volt AC electric power to a 220 Volt AC electrical outlet comprising:

a cover including an electrical outlet positioned therein and being capable of carrying 220 Volt AC electric power, a plug located below said cover electrically connected to said electrical outlet, said plug being adapted to be coupled to the electrical connections in the well for the removed heater element for supplying 220 Volt AC electric power to said outlet, and said cover fitting over said well.

9. An adapter as claimed in claim 8, in which:

said cover fits over said well and serves as a mounting for supporting said outlet in position for use of the outlet.

10. An adapter as claimed in claim 8, in which:

an electric circuit breaker is electrically connected with the outlet for limiting the amount of electric current which can be drawn from said outlet.

11. An adapter as claimed in claim 8, in which:

said cover has an upstanding column, and said outlet is supported in said column.

12. An adapter as claimed in claim 11, in which:

said outlet faces from said column at an inclination to the horizontal.

13. An adapter as claimed in claim 11, in which:

said outlet faces horizontally from one side of said column.

14. An adapter as claimed in claim 12, in which:

said column is rotatable about a vertical axis through an angle relative to the cover of at least 180° for aiming the outlet toward the most convenient direction for the user.

15. An adapter as claimed in claim 13, in which:

said column is rotatable relative to the cover about a vertical axi through an angle of at least 180° for facing the outlet toward a desired direction for use.

16. An adapter as claimed in claim 8, including:

means for releasably holding the adapter in the well in the electric range for preventing inadvertent dislodgement of the adapter during use.

* * * * *